United States Patent [19]

Tanikawa

[11] 4,447,160

[45] May 8, 1984

[54] LEAP YEAR COMPENSATION CIRCUIT

[75] Inventor: Kowji Tanikawa, Tokyo, Japan

[73] Assignee: Olympus Optical Co., Ltd., Tokyo, Japan

[21] Appl. No.: 536,237

[22] Filed: Sep. 28, 1983

Related U.S. Application Data

[63] Continuation of Ser. No. 368,310, Apr. 14, 1982, abandoned.

[30] Foreign Application Priority Data

Apr. 22, 1981 [JP] Japan ..... 56-60781
Apr. 22, 1981 [JP] Japan ..... 56-60782

[51] Int. Cl.[3] ..... G04B 19/24; G04B 27/00
[52] U.S. Cl. ..... 368/34; 368/28
[58] Field of Search ..... 368/101, 28, 29, 30–34

[56] References Cited

U.S. PATENT DOCUMENTS

| | | | |
|---|---|---|---|
| 3,333,410 | 8/1967 | Barbella | 58/4 |
| 3,797,222 | 3/1974 | Kato | 58/4 |
| 3,866,406 | 2/1975 | Roberts | 58/4 |
| 3,961,472 | 6/1979 | Riehl | 58/4 |
| 4,117,657 | 10/1978 | Shimizu | 58/4 |
| 4,133,170 | 1/1979 | Kashio | 368/28 X |
| 4,214,433 | 7/1980 | Terao | 368/28 |
| 4,228,644 | 10/1980 | Watanbe et al. | 368/28 |
| 4,253,169 | 2/1981 | Salah | 368/28 X |
| 4,271,493 | 6/1981 | Tamaru et al. | 368/28 |
| 4,271,494 | 6/1981 | Miyazaki | 368/28 X |
| 4,320,476 | 3/1982 | Berney | 368/28 |
| 4,361,874 | 11/1982 | Yasuda | 368/28 X |

FOREIGN PATENT DOCUMENTS

| | | | |
|---|---|---|---|
| 8234 | 2/1980 | European Pat. Off. . | |
| 2539225 | 3/1976 | Fed. Rep. of Germany . | |
| 2548511 | 5/1976 | Fed. Rep. of Germany . | |
| 2428872 | 1/1980 | France . | |
| 55-39081 | 3/1980 | Japan | 368/28 |
| 55-47472 | 4/1980 | Japan | 368/28 |
| 55-75675 | 6/1980 | Japan | 368/28 |
| 2077465 | 12/1981 | United Kingdom . | |

OTHER PUBLICATIONS

IBM Technical Disclosure Bulletin, vol. 18, No. 8, Jan. 1976, pp. 2515,16 E. Ying "Microprocessor for a Perpetual Calendar Display".

Horological Journal, vol. 116, No. 4, Oct. 1973, pp. 3 to 10, J. F. K. Nosworthy "The Cranleigh School Quartz–Crystal . . . Calendar".

Wireless World, vol. 80, No. 1468, Dec. 1974, pp. 491–495 "A Digital Clock and Calendar".

10e Congres International de Chronometrie, No. 3, Sep., 1979, Conference No. E2.1, pp. 271–278, C. Piguet et al.: "Conception d'un Microprocesseur Horloger".

*Primary Examiner*—Bernard Roskoski
*Assistant Examiner*—Terry Flower

[57] ABSTRACT

This invention provides a leap year compensation circuit. Date data from an electronic watch circuit is compared with leap year data from a memory circuit. If this date data represents a leap year, the next day after the end of February is corrected to a date in a leap year calender. Leap year compensated date data is set in the watch circuit.

11 Claims, 12 Drawing Figures

| ADDRESS | DATA |
|---|---|
| 0 | 1980 |
| 1 | 1984 |
| 2 | 1988 |
| 3 | 1992 |
| 4 | 1996 |
| ⋮ | ⋮ |

| ADDRESS | DATA |
|---|---|
| 0 | 1980 |
| 1 | 1984 |
| 2 | 1988 |
| 3 | 1992 |
| 4 | 1996 |
| ⋮ | ⋮ |

| DOMINICAL YEAR | | ERA | |
|---|---|---|---|
| ADDRESS | DATA | ADDRESS | DATA |
| 0 | 80 | 10 | 55 |
| 1 | 84 | 11 | 59 |
| 2 | 88 | 12 | 63 |
| 3 | 92 | 13 | 67 |
| ⋮ | ⋮ | ⋮ | |

LEAP YEAR COMPENSATION CIRCUIT

This is a continuation of application Ser. No. 368,310, filed Apr. 14, 1982, now abandoned.

BACKGROUND OF THE INVENTION

The present invention relates to a leap year compensation circuit for a digital watch and, more particularly, to a leap year compensating circuit for a digital watch which multifunctionally uses time and date information.

Digital watches have recently been assembled in various devices. Along with time information of the digital watch, operating conditions of these devices are controlled. As an example, information such as date and time of issuance of a bill to a customer may be displayed. The digital watch has been widely utilized in a variety of applications. A one-chip wristwatch-type LSI which is directly connected to a display element is not suitable for the above applications. A simple LSI for a digital watch which combines counters is used for the above purpose. With the LSI of this type, compensation for a short month (consisting of 30 days) and a long month (consisting of 31 days) can be performed. However, it can hardly compensate for a leap year. Even if a digital watch can compensate for a leap year, setting for the leap year must be done before 11 o'clock 59 minutes and 59 seconds at midnight on February 28. If this setting is not done, leap year compensation cannot be performed and the watch advances as if for a regular year. On the other hand, if the setting for the leap year is not released, leap year compensation is continued even into regular years. In a device with the digital watch of this type, incorrect data may be printed.

Further, dates may be displayed in the dominical year (AD) or in a Japanese era, that is, "Showa" (the first year of "Showa" era corresponds to 1925 AD). Some devices display dates either in AD for export use or in the Japanese era for domestic use. However, in addition, a leap year compensation circuit has been desired for some time.

SUMMARY OF THE INVENTION

It is an object of the present invention to provide a leap year compensation circuit of simple arrangement which can be built into a digital watch and which automatically and properly performs leap year compensation.

In order to achieve the above object of the present invention, there is provided a leap year compensation circuit for a digital watch, comprising time counting means for generating date data including at least year, month and day, memory means for storing leap year data corresponding to a leap year table, comparing means for comparing the leap year data stored in said memory means and the date data generated by said time counting means, and leap year setting means for setting said time counting means to a leap year calendar according to comparison results obtained by said comparing means.

DETAILED DESCRIPTION OF THE PREFERRED EMBODIMENTS

Figures 1, 2:
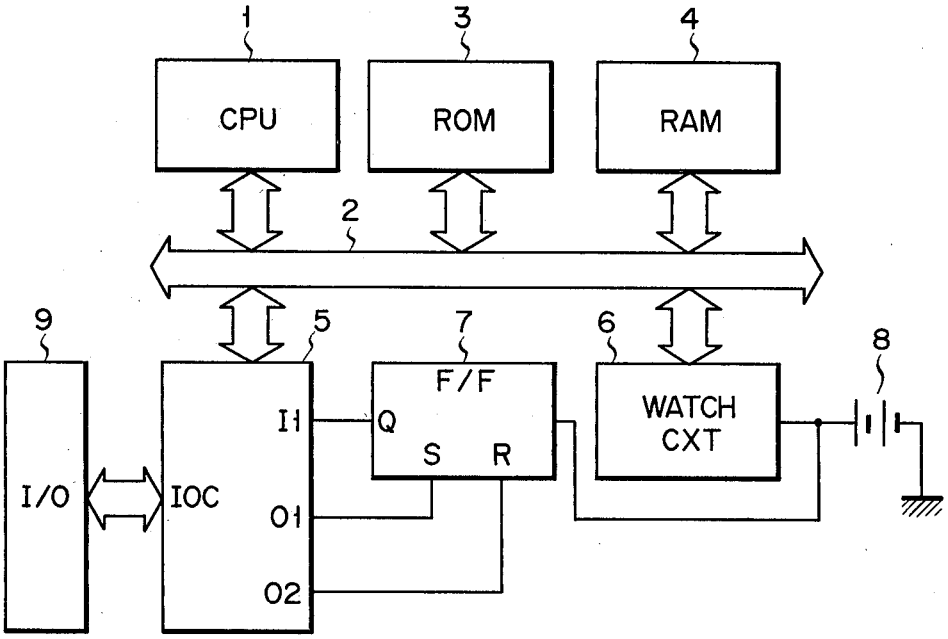
FIG. 1 is a block diagram of the main part of a leap year compensation circuit for a digital watch according to one embodiment of the present invention.
FIG. 2 is a table showing leap year data stored in a ROM shown in FIG. 1.

FIG. 1 shows a block diagram of the main part of a leap year compensation circuit for a device which includes a digital watch. A CPU 1, a ROM 3 and a RAM 4 are coupled by a bus 2. The bus 2 is connected to an I/O controller 5 (to be referred to as an IOC hereinafter) and an electronic watch circuit (time counting circuit) 6. The IOC 5 is connected to a leap year setting circuit 7 which comprises a flip-flop. The leap year setting circuit 7 together with the time counting circuit 6 is powered by back-up batteries 8. Further, I/O devices 9 such as a display unit or a printer are connected to the IOC 5. The ROM 3 stores leap year data corresponding to a leap year table shown in FIG. 2, a compensation program of the leap year compensation sequence, and a program for executing the operation sequence of the device. Data is read out from and written in the RAM 4 during data processing.

Figure 3:
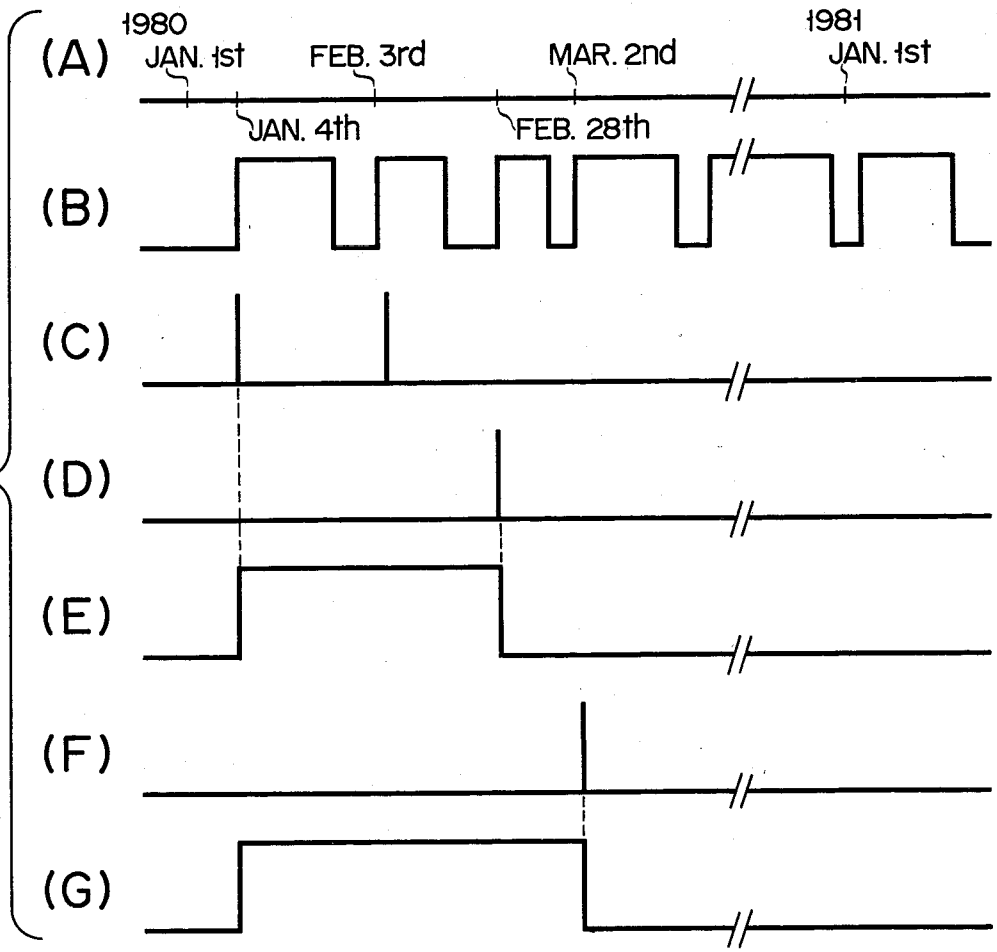
FIG. 3 shows timing charts for explaining the mode of operation of the leap year compensation circuit shown in FIG. 1.
Figure 4:
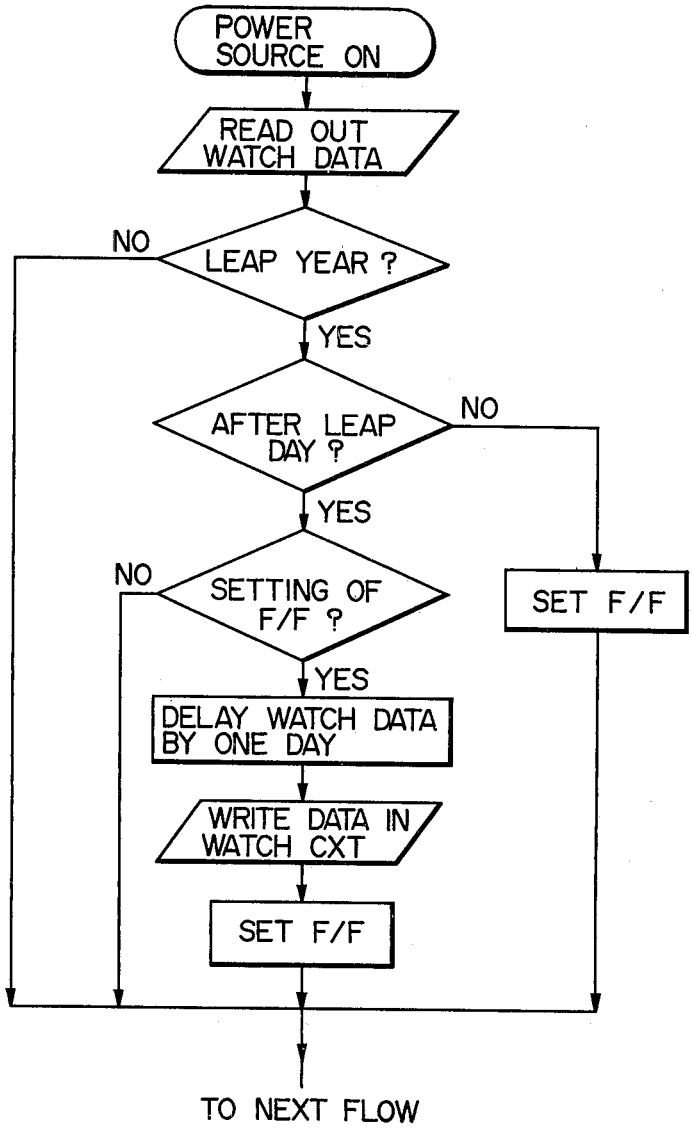
FIG. 4 shows a flow chart for explaining the mode of operation of the circuit shown in FIG. 1.

The mode of operation of the above device including the watch circuit 6 will be described with reference to timing charts of FIG. 3 and a flow chart of FIG. 4. The device must be operated in a non-periodical manner as shown in FIGS. 3(A) and (B). When power is supplied to operate the device at 10 o'clock on Jan. 4, 1980, the CPU 1 reads out date-time data, that is, data of 10 o'clock, 00 minute and 00 second on Jan. 4, 1980 of the watch circuit 6 through the bus 2. The CPU 1 then compares the readout year data, that is, data of "1980" and leap year data of leap year table data (FIG. 2) stored in the ROM 3. When the CPU 1 judges that input data corresponds to leap year data, the CPU 1 then judges whether or not the date represented by data from the watch circuit 6 corresponds to the data after February 29. Since the current date is January 4, the CPU 1 generates a signal from an output port 01 of the IOC 5 (FIG. 3(C)) through the IOC 5. In response to this signal, the flip-flop constituting the leap year setting circuit 7 is set. The output of level "1" is output from an output terminal Q of the flip-flop. This indicates that this year is a leap year but leap year compensation is not yet performed. In this condition, when power is cut off from the device and the device is inoperative, the watch circuit 6 and the flip-flop of the leap year setting circuit 7 are powered by the back-up batteries 8. The watch circuit 6 continues counting time and the set status of the flip-flop is maintained. When power is supplied to the device again on February 3, as described above, the CPU 1 reads out date data from the watch circuit 6 and compares it with leap year table data and data of February 29. February 3 is prior to February 29, so the same operation as described above is repeated. Although a set signal is supplied from the IOC 5 to the flip-flop as shown in FIG. 3(C), the set status of the flip-flop does not change as shown in FIG. 3(E). An output from the output terminal Q of the flip-flop may be checked through an input port I1 so as not to receive the set signal again. The operation described above is repeated every time power is supplied to the device until 11 o'clock 59 minutes and 59 seconds at midnight on Feb. 28, 1980. When power is supplied to the device on February 29, the CPU 1 reads out date-time data of the watch circuit 6 in the same manner as described above. However, since the watch circuit 6 presents time data of corresponding time on March 1 after data of 11 o'clock, 59 minutes and 59 seconds on Feb. 28, 1980, the CPU 1 judges that date compensation must be performed. The output status of the flip-flop is then checked through the input port I1 of the IOC 5. Since the flip-flop 7 is set, that is, since leap year compensation is not yet performed, the CPU 1 compensates for date-time data. In particular, the CPU 1 corrects time data on March 1 which is read out from the watch circuit 6 to time data on February 29 read out from the ROM 3, and supplies the corrected data to the watch circuit 6. Thus, data in the watch circuit 6 is compensated. The watch circuit 6 counts time on the basis of compensated date. In this condition, the CPU 1 supplies the set signal shown in FIG. 3(D) to the flip-flop which is then reset. The reset status of the flip-flop is judged by the CPU 1 as the completion of leap year compensation.

In the above case, power is supplied to the device on February 29. However, when power is supplied to the device on March 2 as shown in FIG. 3(F) instead of February 29 because February 29 is, for example, a national holiday and power is cut off from the device on that day, non-compensated data of corresponding time on Mar. 3 is corrected to data of corresponding time on Mar. 2, 1980. The output from the flip-flop is shown in FIG. 3(G). Leap year compensation in this case is accomplished simply by decrementing one from the value of date data of the watch circuit 6.

According to the embodiment described above, date data is read out from the watch circuit 6 and is compared with leap year table data stored in the ROM. If date data corresponds to leap year data, the leap year setting circuit 7 is set to the leap year mode. Then, it is judged whether or not the current date is after February 29. If so, the watch circuit 6 is automatically set to the leap year mode. Leap year compensation is performed by a control circuit such as a CPU. The simple and discrete watch circuit of this type which comprises a counter is thus used for leap year compensation. An LSI for an electronic watch is not used.

In the above embodiment, the flip-flop which is powered by the back-up batteries is used as the leap year setting circuit 7. However, a nonvolatile semiconductor memory or an electromechanical memory such as a latching relay may be used in place of the flip-flop. Alternatively, if the CPU includes a nonvolatile memory, this memory may be used instead of the flip-flop. Further, if the watch circuit includes a leap year compensation circuit, the output from the output terminal Q of the flip-flop may be connected to a leap year setting terminal of the watch circuit. In the above embodiment, the leap year is discriminated in dominical year. However, the leap year may be judged on the basis of the Japanese era "showa". Further, the current year may be judged by calculated leap year data instead of leap year table data. In the above embodiment, the next day after February 28 is defined as Mar. 1 in the watch circuit. However, the next day may be February 29. In this case, if the current year does not correspond to leap year data, the flip-flop may be set to increment the value of date data after February 28.

In the above embodiment, the leap year is judged in accordance with values in the dominical year or the Japanese era. A leap year compensation ciruit which arbitrarily judges the current year as a leap year on the basis of the dominical year or the Japanese era will be described according to another embodiment of the present invention. The same reference numerals as in the first embodiment denote the same parts in the second embodiment, and a detailed description thereof will be omitted.

Figures 5, 6:
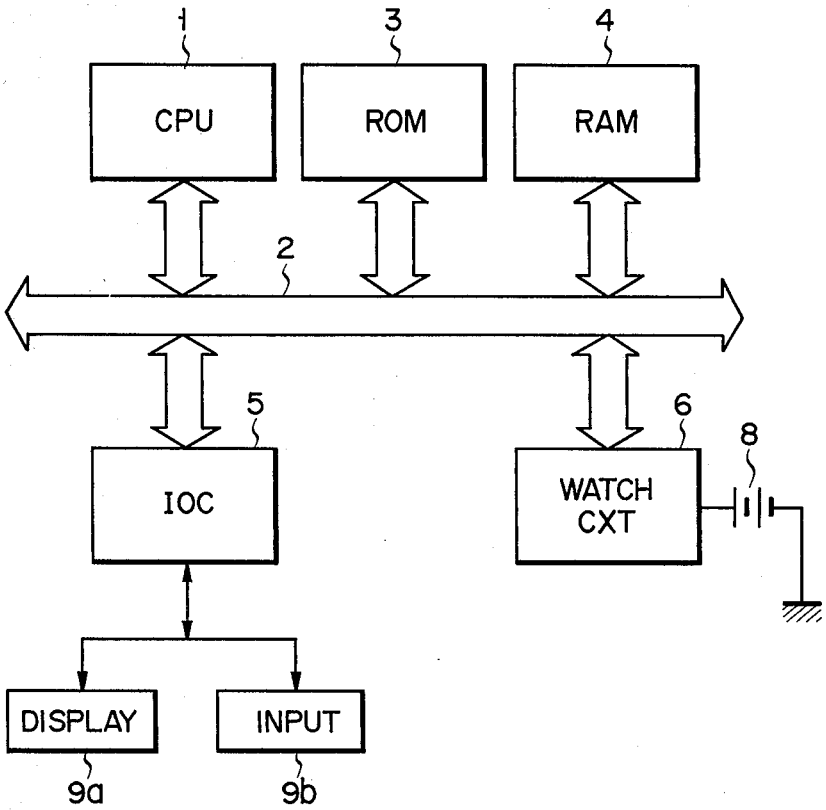
FIG. 5 is a block diagram of a device which includes the leap year compensation circuit for a digital watch according to the present invention.
FIG. 6 is a table showing the leap year data.

Referring to FIG. 5, the CPU 1, the ROM 3 and the RAM 4 are coupled to the bus 2. The IOC 5 and the watch circuit 6 are also connected to the bus 2. The IOC 5 is connected to a display unit *9a* and an input unit *9b*. The watch circuit 6 is powered by the back-up batteries 8. The ROM 3 stores leap year data corresponding to a leap year table including leap years in the dominical year and the Japanese era, as shown in FIG. 6, a program for the operation sequence of the device, a leap year compensation sequence program and the like. The CPU 1 controls operation of the device and leap year compensation according to the programs stored in the ROM 3. Data is read out from or written in the RAM 4 during data processing.

Figure 7:
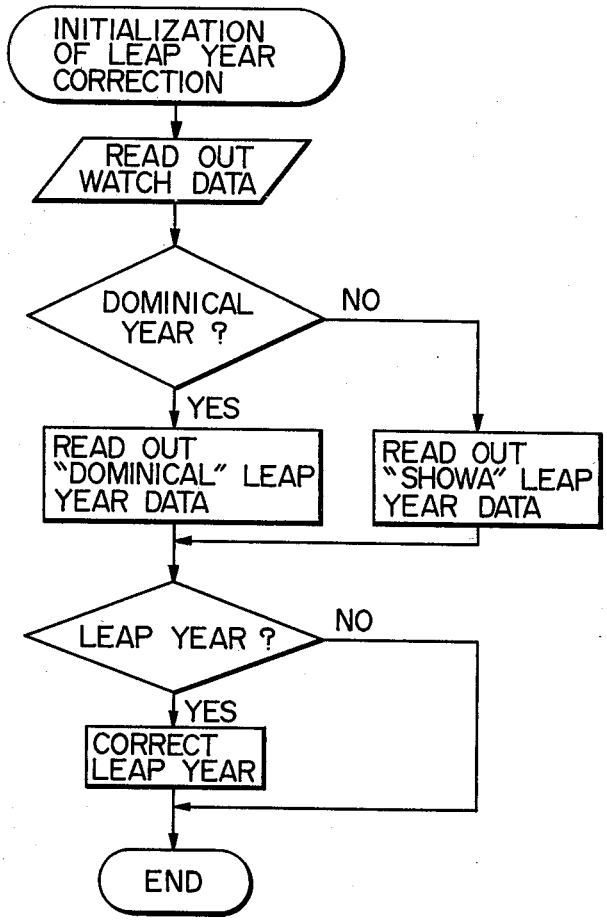
FIG. 7 is a flow chart for explaining a leap year compensation sequence of the device of FIG. 5.

The mode of operation of the device in FIG. 5 will be described with reference to a flow chart in FIG. 7. When the user sets the "Dominical year" mode with a setting switch of the input unit *9b*, the watch circuit 6 is set to produce time data in the dominical year. The CPU 1 then executes the leap year compensation routine. The CPU 1 reads out time data of 9 o'clock, 30 minutes and 00 second on Mar. 23, 1981 from the watch circuit 6. In practice, year data is read out as data of "81" instead of "1981". When the CPU 1 judges that the "Dominical year" mode has been set in accordance with the setting status of the setting switch, the CPU 1 reads out dominical leap year data of a leap year table (FIG. 6) stored in the ROM 3 and compares it with time data read out from the watch circuit 6. If this time data corresponds to a leap year, the CPU 1 performs leap year compensation. In this condition, if the watch circuit 6 is arranged so as to generate data of 0 o'clock, 0 minute and 0 second on March 1 after data of 11 o'clock, 59 minutes and 59 seconds on February 28, the CPU 1 functions to decrement one day from date data of 9 o'clock, 30 minutes and 00 second on Mar. 23, (19)81. Thus, time data is renewed as data of 9 o'clock, 30 minutes and 00 second on Mar. 22, (19)81. The renewed time data is supplied to the watch circuit 6. A leap year calendar is thus set in the watch circuit 6. On the other hand, if the "showa era" mode is set with the setting switch, the watch circuit 6 is set to produce "showa era" time data. "Showa era" leap year data is read out from the ROM 3 and compared with time data stored in the watch circuit 6. If the time data corresponds to a leap year, leap year compensation is performed in the same manner as in the dominical year mode. Time data is thus renewed as data of 9 o'clock, 30 minutes and 00 second on March 22, 56. (The 56th year in the Showa era corresponds to 1981 AD.)

Figure 8:
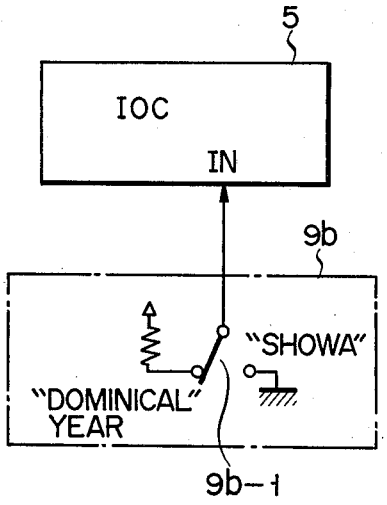
FIG. 8 is a block diagram of a circuit including a setting switch of an input unit.
Figure 9:
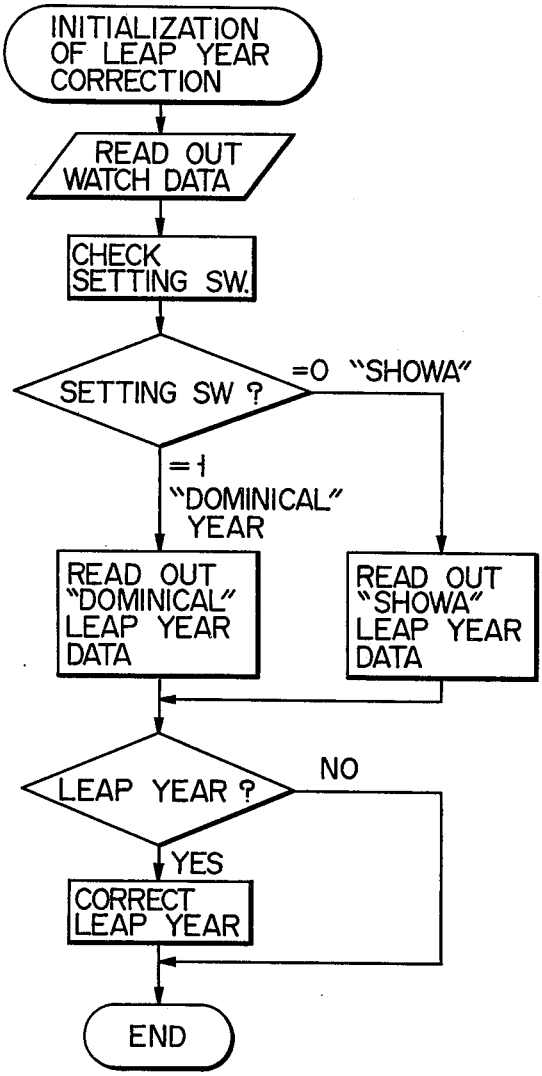
FIG. 9 is a flow chart of a leap year compensation sequence based on mode data set by the setting switch shown in FIG. 8.

FIG. 8 shows a setting switch 9*b*-1 of the input unit 9*b*. When the setting switch 9*b*-1 is set to the "Dominical year" mode, a signal of level "1" is supplied to the IOC 5. On the other hand, if the setting switch 9*b*-1 is set to the "Showa era" mode, a signal of level "0" is supplied to the IOC 5. When the CPU 1 detects one of the signals, it judges that the mode is set to the "Dominical year" mode or the "Showa era" mode. The flow chart for this operation is shown in FIG. 9. As is seen from this flow chart, after the time data is read out from the watch circuit 6 and the signal of level "1" is detected, dominical leap year data is read out from the ROM 3. However, if the signal of level "0" is detected, "Showa era" leap year data is read out. The readout leap year data is compared with year data of the time data read out from the watch circuit 6. Leap year compensation is performed in accordance with comparison results.

Figure 10:
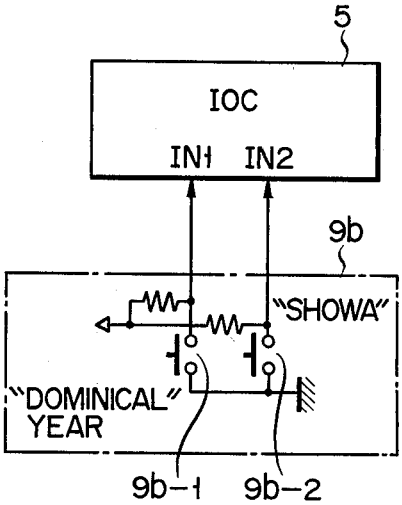
FIG. 10 is a block diagram of a circuit including another setting switch.
Figure 11:
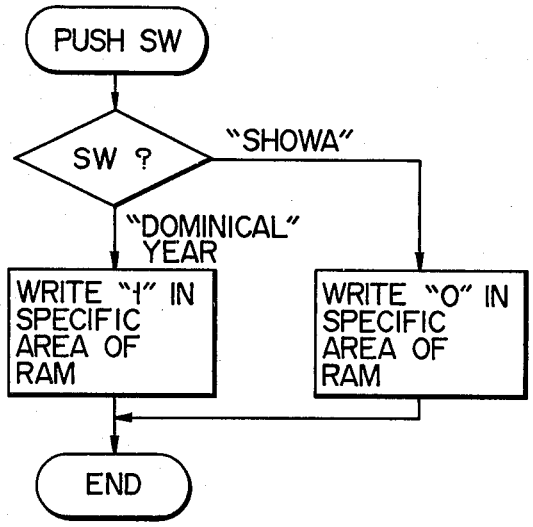
FIG. 11 is a flow chart of the leap year compensation sequence for performing leap year compensation based on mode data set with the setting switch of FIG. 10.

FIG. 10 shows changes in level at input terminals IN1 and IN2 of the IOC 5 in accordance with operation of the setting switches 9*b*-1 and 9*b*-2 of the input unit 9*b* serving as the dominical year setting switch and the Showa era setting switch, respectively. Data of level "1" is stored in a memory area assigned at a specific address of the RAM 4 through the IOC 5 in the "Dominical year" mode. However, in the "Showa era" mode, data of level "0" is stored in the memory area. This status is explained by the flow chart of FIG. 11. When the dominical year setting switch 9*b*-1 is depressed, data of "1" is stored in the memory area assigned at the specific address of the RAM 4. However, with the Showa era setting switch 9*b*-2, data of "0" is written in the memory area. The CPU 1 discriminates dominical year data from "Showa era" data and executes the leap year compensation routine.

Figure 12:
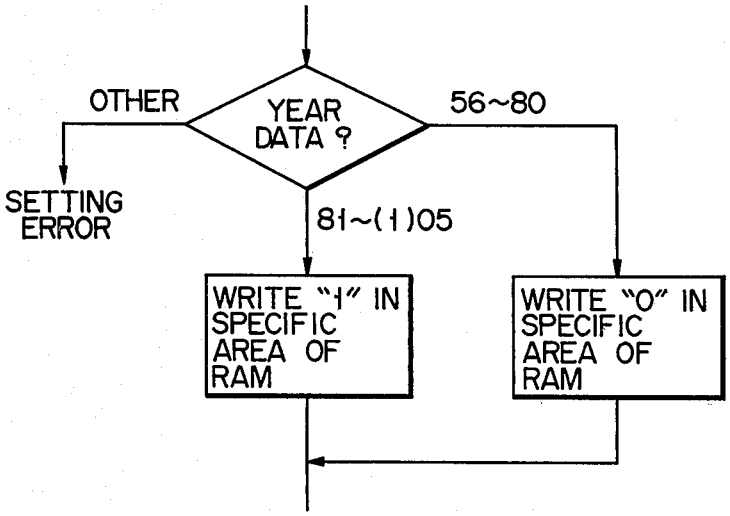
FIG. 12 is a flow chart of a leap year compensation sequence for performing leap year compensation by automatically judging AD or a Japanese era in accordance with a value of year data.

Since lower two digits of a dominical year differ from the corresponding year in the Showa era by 25, year data of time data of the watch circuit 6 may be judged as a dominical year if it is within a range of 81 to (1)05, that is, 1981 to 2005 AD, or as a year in the Showa era if it is within a range of 56 to 80, that is, 1981 to 2005 AD in the flow chart in FIG. 12. If the year data is judged as a year in AD, data of level "1" is written in a memory area assigned at the specific address of the RAM 4. However, if the data is judged as a year in the Showa era, data of level "0" is written in the memory area. In accordance with data stored in the RAM 4, dominical leap year compensation or "Showa era" leap year compensation is performed. With the above arrangement, the setting switches need not be used. In this example, time data is directly compared with dominical leap year data if year data varies within the range of 81 to (1)05. Similarly, time data can be directly compared with "Showa era" leap year data. If the range is extended over 25 years, a dominical year cannot be discriminated from a year in the Showa era. However, a device with service life over 25 years does not substantially exist in practice. Therefore, the above arrangement is very convenient and highly reliable.

As described above, year data is automatically judged as year data in the dominical year or in the Showa era. Based on this judgement, time data is compared with dominical leap year data or "Showa era" leap year data. Leap year compensation is automatically performed according to comparison results. Therefore, proper calender information is constantly obtained regardless of years in the dominical or the Showa era.

Calender data thus obtained, that is, data of year, month and day can be displayed at the display unit 9*a* or printed on a bill or the like.

What is claimed is:

1. A leap year compensation circuit comprising electronic watch means for generating date data including at least year, month and day, memory means for storing leap year data respectively representing a plurality of leap years, and juding/compensating means connected to said electronic watch means and said memory means, for comparing the date data generated by said electronic watch means and the leap year data stored in said memory means, and for judging whether or not the date data corresponds to the leap year data and is after the end of February, and leap year setting means for recording leap year judgement and incompletion of leap year compensation in accordance with a judgement result, said comparing means having function compensating for said watch means for a leap year date in accordance with the judgment result and the content of said recording means.

2. A circuit according to claim 1 wherein said leap year setting means comprises a flip-flop which is set when leap year compensation is not yet performed in the case of leap year judgment and is reset when leap year compensation is incomplete.

3. A circuit according to claim 2, wherein said watch means and said leap year setting means are powered by back-up batteries.

4. A circuit according to claim 1, wherein said memory means stores data of leap years in the dominical year.

5. A leap year compensation circuit comprising electronic watch mans for generating date data including at least year, month and day in a dominical year mode or in a predetermined "era" mode, memory means for storing leap year data representing leap years in the dominical year and in a predetermined "era", selecting means for selecting one of the dominical year mode and the predetermined "era" mode and for generating one of dominical year data and predetermined "era" data, and judging/compensating means, connected to said electronic watch means, said memory means and said selecting means, for setting said watch means to one of the modes in accordance with the selected one of the dominical year data and the predetermined "era" data generated by said selecting means, comparing the date data in the set mode generated by said watch means and corresponding leap year data stored in said memory means to judge whether or not the year of the date data is a leap year and the date of the date data is after the end of February, and for compensating said watch means for leap year data data.

6. A circuit according to claim 5, wherein said selecting means comprises a switching circuit which generates a signal of a first level when the dominical year mode is set and which generates a signal of a second level when the predetermined "era" mode is set.

7. A circuit according to claim 6, wherein said switching circuit comprises a changeover switch which has a dominical year selection terminal which receives the signal of the first level and a predetermined "era" selection terminal which receives the signal of the second level.

8. A circuit according to claim 5, wherein said selecting means comprises means which has at least two switches and which generates one of the dominical year data and the predetermined "era" data with operation of said switches.

9. A circuit according to claim 5, wherein said selecting means comprises judging means for judging a dominical year from a year in a predetermined "era" in accordance with a data piece representing a year of the date data generated by said watch means.

10. A circuit according to claim 9, wherein said judging means sets the predetermined "era" data if the year represented by the data piece is within a range of 56 to 80 and the dominical year data if the year represented by the data piece is within a range of 81 to 105.

11. A circuit according to claim 2, wherein said watch means and said leap year setting means are powered by back-up batteries.

* * * * *